US007121107B2

(12) United States Patent
Ishikura et al.

(10) Patent No.: US 7,121,107 B2
(45) Date of Patent: Oct. 17, 2006

(54) CONTINUOUS TRANSFER TYPE FREEZER

(75) Inventors: Kou Ishikura, Koto-ku (JP); Takahiro Arai, Koto-ku (JP); Akira Taniyama, Koto-ku (JP)

(73) Assignee: Mayekawa Mfg. Co., Ltd., (JP)

( * ) Notice: Subject to any disclaimer, the term of this patent is extended or adjusted under 35 U.S.C. 154(b) by 0 days.

(21) Appl. No.: 11/101,380

(22) Filed: Apr. 7, 2005

(65) Prior Publication Data

US 2006/0090497 A1 May 4, 2006

Related U.S. Application Data

(63) Continuation of application No. PCT/JP2004/016464, filed on Oct. 29, 2004.

(51) Int. Cl.
*F25D 25/04* (2006.01)

(52) U.S. Cl. ..... 62/380; 198/790; 198/793; 99/443 C; 99/443 R

(58) Field of Classification Search ..... 62/63, 62/380, 345; 198/790, 793; 99/443 R, 443 C
See application file for complete search history.

(56) References Cited

U.S. PATENT DOCUMENTS 3,868,272 A * 2/1975 Tardoskegyi ..... 134/26
4,467,537 A * 8/1984 Trotscher ..... 34/635
4,679,542 A * 7/1987 Smith et al. ..... 126/21 A
4,702,161 A * 10/1987 Andersen ..... 99/470
5,019,404 A * 5/1991 Meisner ..... 426/249
5,180,898 A * 1/1993 Alden et al. ..... 219/388
5,277,924 A * 1/1994 Padilla ..... 426/523
5,285,582 A * 2/1994 Kouchi et al. ..... 34/638
5,335,682 A * 8/1994 Yoshimura et al. ..... 134/72
5,356,481 A * 10/1994 Yoshimura et al. ..... 134/22.1
5,388,752 A * 2/1995 Kawakatsu ..... 228/20.1
5,408,921 A * 4/1995 Persson et al. ..... 99/443 C
6,092,388 A * 7/2000 Waldstrøm ..... 62/345
6,622,513 B1 * 9/2003 Howard ..... 62/380
6,656,279 B1 * 12/2003 Seifert ..... 118/602

FOREIGN PATENT DOCUMENTS

RO 106868 B1 * 7/1993

* cited by examiner

*Primary Examiner*—Mohammad M. Ali
(74) *Attorney, Agent, or Firm*—Rossi, Kimms & McDowell LLP

(57) ABSTRACT

A continuous transfer type freezer for cooling or freezing articles such as foodstuffs transferred on a conveyor belt by spraying chilled air from slit nozzles on the articles is provided in which chilled air jets rectified to have long spray travel is produced, thin stream layer of chilled air is formed on the surface of the article to achieve increased heat transfer, and exhaust passages of the chilled air are formed such that they do not affect the cooling function. A plurality of slit nozzles 5*a*, 6*a* are apposed above and under the conveyor belt along the belt transfer direction, each of the nozzles 5*a*, 6*a* is shaped such that it has an angled and succeeding parallel entrance way so that the chilled air is rectified in the entrance ways and spout from the nozzle opening at large velocity, and exhaust passages 12 are formed between each of the slit nozzles such that the chilled air spouted from the nozzles flows toward both lateral end sides of the conveyor belt 2.

7 Claims, 6 Drawing Sheets

CONTINUOUS TRANSFER TYPE FREEZER

CROSS REFERENCE TO RELATED APPLICATIONS

This is a continuation of International Application PCT/JP2004/016464, with an international filing date of Oct. 29, 2004; this International Application was not published in English.

TECHNICAL FIELD

The present invention relates to a transfer type freezer capable of continuous cooling or continuous freezing; in which a chilled air jet is impinged on an article transferred on a conveyer belt, whereby a thin stream layer is formed on the surface of the article owing to Coanda effect resulting in higher cooling effect; in which exhaust passages are formed for guiding the air impinged on the article in both width directions of the belt; and in which apparatuses are located in a single space surrounded by the housing, whereby the chilled air can circulate in the housing more easily, its flow loss is reduced, and maintenance such as cleaning can be performed easily.

BACKGROUND ART

A method to cool, heat, or dry an article such as foodstuffs as it is transferred on a belt conveyor in an oblong housing has been disclosed in prior arts, in which a gas jet is allowed to impinge on the article. In those prior arts, a chilled air is spouted from hole nozzles or slit nozzles perpendicular to the surface of the belt and a thin stream layer is formed on the surface of the article placed on the belt owing to Coanda effect, by which heat transfer between the chilled air and the surface of the article is increased.

For example, a transfer type freezer is disclosed in Japanese Patent Application Publication No. 8-507596 (prior art 1), in which a tunnel is provided in a housing having an entrance and exit opening for a conveyor belt to surround the conveyor belt with the upper wall, two side walls extending along the transfer direction of the conveyor belt, and the bottom wall of the tunnel, the inside of the tunnel is vacuumized by a gas sucking means to form gas circulation in the housing such that the gas in the housing flows through holes formed in said upper wall into the tunnel, exits from the tunnel through an opening formed in said bottom wall, and again flows into the tunnel through said holes, thus a gas jet stream is formed to impinge against the article placed on the conveyor belt.

FIG. 7 is a schematic representation of the equipment of said prior art 1 for explaining the principle of operation thereof, and FIG. 7(*a*) is a partial enlarged detail of FIG. 7. The equipment comprises a housing 01, in which a tunnel 02 is provided to surround a treating zone 03. The gas in the treating zone 03 is sucked by a sucking means 04 to vacuumize the treating zone. A conveyor belt 05 transfers foodstuffs 06 through the tunnel.

In FIG. 7, holes are bored only in the upper wall 07 of the tunnel 02, the upper and lower surfaces of the upper wall being flat and nozzles being formed without no part protruding from the upper and lower surfaces of the upper wall (see FIG. 7*a*). In a preferable embodiment, holes are bored also in the bottom wall of the tunnel 02.

During operation of the equipment, the sucking means 04 vacuumize the inside space of the tunnel 02 so that the air in the housing is sucked through the nozzles 8 in the upper wall 07 and air jets 09 are formed to impinge against the conveyor belt 05 and the foodstuffs 06 placed thereon.

In Japanese Laid-Open Patent Application No. 11-63777 (prior art 2) is disclosed a transfer type freezer in which articles such as foodstuffs are placed on a conveyor belt passing through an oblong housing, a number of slits to produce jet streams are formed in an upper and lower plates facing the conveyor belt, the jet streams of chilled air impinge on the articles to cool or freeze them, and the chilled air that has cooled the articles is exhausted in one direction.

With said prior art 1, a vacuum chamber is necessary to be provided in order to vacuumize the tunnel surrounding the conveyor belt. For this purpose, a large fan is required as a sacking means and large power is needed to drive the fan. Further, as air jet streams are formed by sacking air by the fan through the holes bored in the upper wall, the jet flows lack in directionality and tend to diffuse or proliferate. Therefore, the air jet streams do not necessarily impinge on the articles at high speed resulting in low heat transfer between the air and the surface of the articles.

Further, air exit openings are provided below the conveyor belt at certain intervals, so nozzles can not be provided where the exit openings are provided under the conveyor belt, resulting in decreased cooling efficiency. There is no air exit opening above the conveyor belt and the air introduced into the tunnel through the nozzles (holes) bored in the upper wall must flow through the holes bored in the conveyor belt to be exhausted from the tunnel. Therefore, the conveyor belt must have holes and a conveyor belt not having holes can not be used. Therefore, loading density of the articles transferred on the belt is limited, because there must be left on the belt space not occupied by the articles in order to allow the air introduced into the tunnel through the nozzles (holes) to flow downward through the holes of the conveyor belt.

According to the prior art 2, chilled air jets impinge against both upper surface and undersurface of the conveyor belt and then the chilled air is exhausted in one direction perpendicular to the belt transfer direction, the air jets tend to incline to said exhausting direction, which causes reduction in heat transfer coefficient between the chilled air and the surface of the article on the belt. Further, the space in which the conveyor belt passes through is narrow and inconvenient to clean. Therefore, it is necessary to provide a number of cleaning nozzles, and the installation becomes complicated resulting in increased cost.

DISCLOSURE OF THE INVENTION

The present invention is made in light of the problems mentioned above. An object of the invention is to achieve high heat transfer between the chilled air and the surface of the article to be cooled on a conveyor belt by spouting chilled air from slit nozzles provided above and under a conveyor belt in the form of air jets toward both surfaces of the conveyor belt in the direction perpendicular to the surfaces of the belt, whereby thin chilled air stream layer is formed on the surface of the article by virtue of Coanda effect, resulting in increased heat transfer coefficient between the chilled air and the surface of the article.

The second object of the invention is to increase heat transfer coefficient between the chilled air and the surface of the article to increase cooling effect by allowing thin air stream layer to be formed along the surface of the article by virtue of Coanda effect even when the distance between the nozzle opening and the article is relatively large through rectifying the air flow in the nozzle and giving strong directionality to the air jetted from the nozzle.

The third object of the invention is to provide a structure with which the formation of passages for exhausting chilled air does not constitute a limiting factor of providing nozzles under the conveyor belt, for if the number of nozzles provided under the conveyor belt is limited as is in said prior art 1, cooling effect is decreased.

The fourth object of the invention is to evade partitioning the space in the housing and simplify the apparatuses in the housing for generating the circulation of chilled air in the housing so that flow loss of the chilled air circulation is reduced and in addition inspection and maintenance such as cleaning can be easily performed.

To attain the objects, the present invention proposes a continuous transfer type freezer comprising a housing having an entrance opening and an exit opening, a conveyor belt for transferring articles to be cooled from said entrance opening to said exit opening of the housing, a chilled air circulating means consisting of a cooler and a blower, and slit nozzles for spouting chilled air against the articles to be cooled, wherein a plurality of upper slit nozzles and lower slit nozzles are apposed above and under the conveyor belt along the direction of transfer of the belt with the slit of each nozzle perpendicular to the belt transfer direction, and exhaust passages are formed perpendicular to the belt transfer direction between each of the slit nozzles to guide the chilled air spouted from the slit nozzles to both lateral end sides of the conveyor belt.

According to the invention, as exhaust passages are formed between each of a plurality of slit nozzles such that the chilled air spouted from the slit nozzles is allowed to flow toward both lateral end sides of the conveyor belt, the formation of the exhaust passages does not constitute a limiting factor of providing slit nozzles. Therefore, slit nozzles can be located at positions most suited for the articles on the belt and a thin air stream layer can be positively formed on the surface of each article by virtue of Coanda effect.

FIG. 1 is a drawing for explaining the principle of Coanda effect. In the drawing, when a film-like air stream 'k' impinges, for example, on a cylindrical body 'A' in the direction perpendicular to its surface, a thin, stable stream layer 'S' is formed around the surface of the cylindrical body 'A'. Therefore, when chilled air impinges on the surface, heat transfer coefficient between the chilled air and the surface of the cylindrical body 'A' is extremely increased and cooling effect is improved.

Further, by forming exhaust passages to guide the chilled air after it cooled the articles toward both lateral end sides of the conveyor belt, inclined impingement of the air jets spouting from the slit nozzles is evaded, the chilled air after it cooled the article is exhausted smoothly toward both lateral end sides of the conveyor belt, and the exhausted air can easily reach the inlet of the cooler for producing chilled air.

In the invention, it is preferable that each of the slit nozzles is shaped to have an entrance way consisting of a tapered passage and a succeeding parallel passage. By providing entrance way like this, chilled air stream in the slit nozzle is rectified, directionality is given to the spouting stream, and longitudinal coverage, or spray travel of the air jet can be increased. This is explained by FIG. 2. In the drawing, slit nozzle 'n' is shaped to have an entrance way constituting a tapered passage and a succeeding parallel passage 'b', and an air jet 'k' spouting from the nozzle opening impinges against the article transferred on the conveyor belt 'c' at right angles.

The air jet 'k' spouting from the slit nozzle configured like this has strong directionality and hardly diffuses, so the longitudinal coverage 'h' of the air jet can be increased. Therefore, chilled air stream can impinge on the article even when the distance from the nozzle opening to the article is fairly large.

In the invention, it is preferable that circulation of air is generated in said housing such that chilled air flows out from said blower to the space above the upper slit nozzles in the housing, a large part of the chilled air flows to said upper slit nozzles to be spouted from the upper slit nozzles and exhausted through said exhaust passages, the remaining part of the chilled air flows to said lower slit nozzles through ducts having openings at both lateral end sides of the conveyor belt to be spouted from said lower slit nozzles and exhausted through said exhaust passages, and the exhausted air returns to said cooler.

In this way, the chilled air spouted from the slit nozzles and cooled the articles is smoothly guided to both lateral end sides of the belt passing through the exhaust passage to be exhausted outside of the belt without disturbing the air jets spouted against the articles or atmosphere around the articles.

It is preferable that said exhaust passage is formed to be a concave between adjacent slit nozzles. By forming the exhaust passage like this, the formation of the exhaust passage does not constitute a limiting factor of providing slit nozzles, the exhaust passage can be formed very easily between adjacent slit nozzles, and the chilled air cooling the article can be exhausted smoothly from both lateral end sides of the belt resulting in decreased flow loss.

In the invention, it is preferable that the leading end part of slit nozzles located near the entrance opening or exit opening of the housing is inclined in accordance with the difference of pressure near the openings from outside pressure.

When there is a difference between the pressure near the entrance opening and that near the exit opening, there occurs an air flow from the opening side of higher pressure toward the opening side of lower pressure and the air may flow out from the housing or outside air may flow into the housing. By slanting slit nozzles located near the openings against said air flow induced by the pressure difference between both openings, said flowing out of air from the housing and flowing in of outside air can be prevented. Thus, when there is difference between pressures near both openings, said outflow and inflow of air can be shutoff by slanting some of the slit nozzles near the entrance or exit openings.

Further, it is preferable that a plurality of said slit nozzles are integrated into a slit nozzle unit. By this, manufacturing and mounting of slit nozzles become easy.

It is preferable in addition of the construction described above that the slit nozzle unit consisting of a plurality of the slit nozzles and located above the conveyor belt is placed on frames provided at both lateral end sides of the conveyor belt. By composing like this, the upper slit nozzle unit can be detached easily when performing cleaning the upper surface of the conveyor belt and upper slit nozzles which are apt to be contaminated by the article such as foodstuffs, and also inspection and maintenance work becomes easy.

When leading end parts of the slit nozzles are inclined and the slit nozzle unit with inclined slit nozzles is placed on frames provided at both lateral end sides of the conveyor belt, inclination of the leading end parts of slit nozzles can be easily reversed only by changing the lateral direction of the slit nozzle unit, that is, by lifting the unit, turning it by 180° and replacing it on the frames.

BEST MODE FOR EMBODIMENT OF THE INVENTION

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 3:
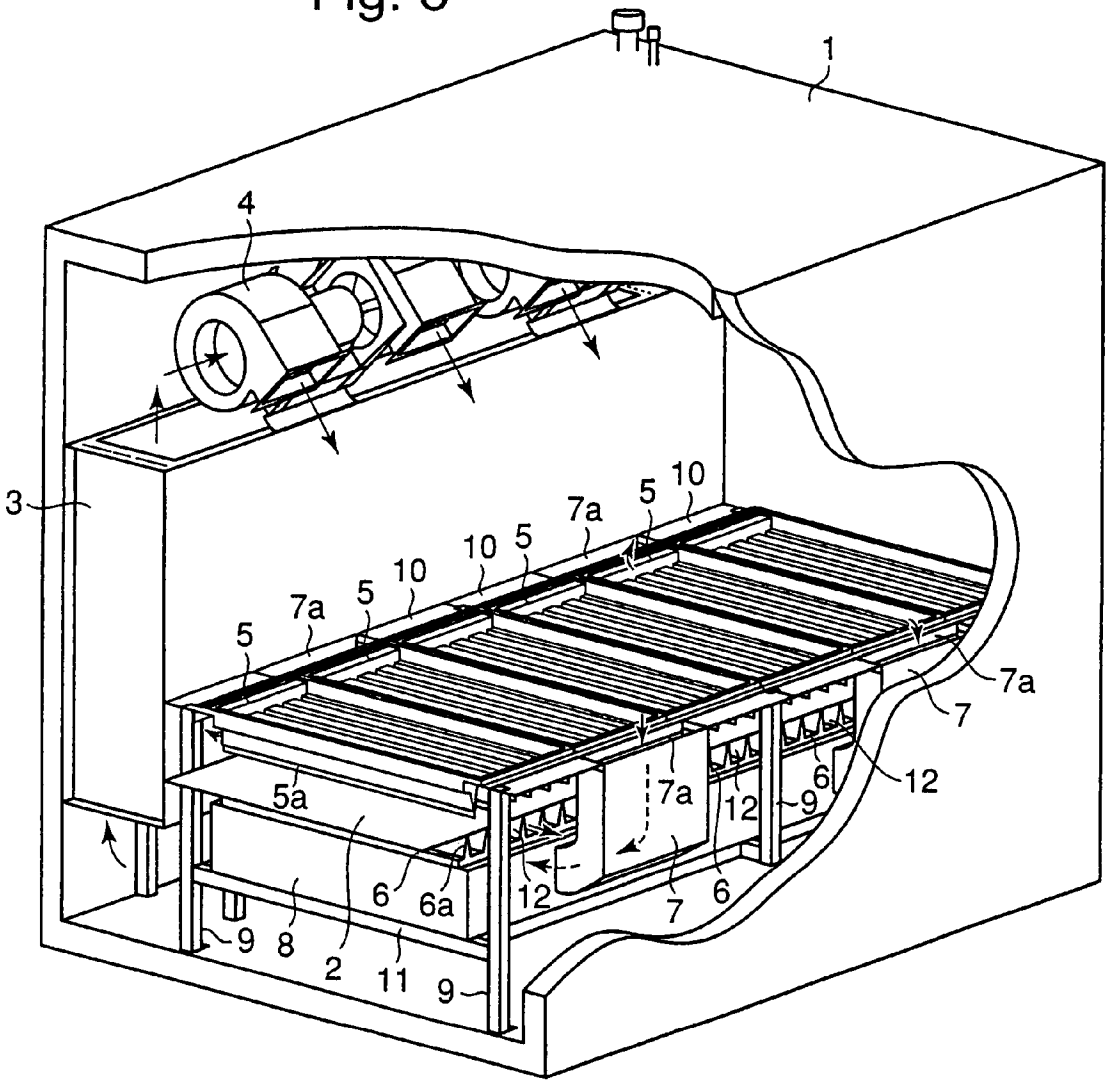
FIG. 3 is a perspective view of the first embodiment of the present invention with partial cutaway.
Figure 4:
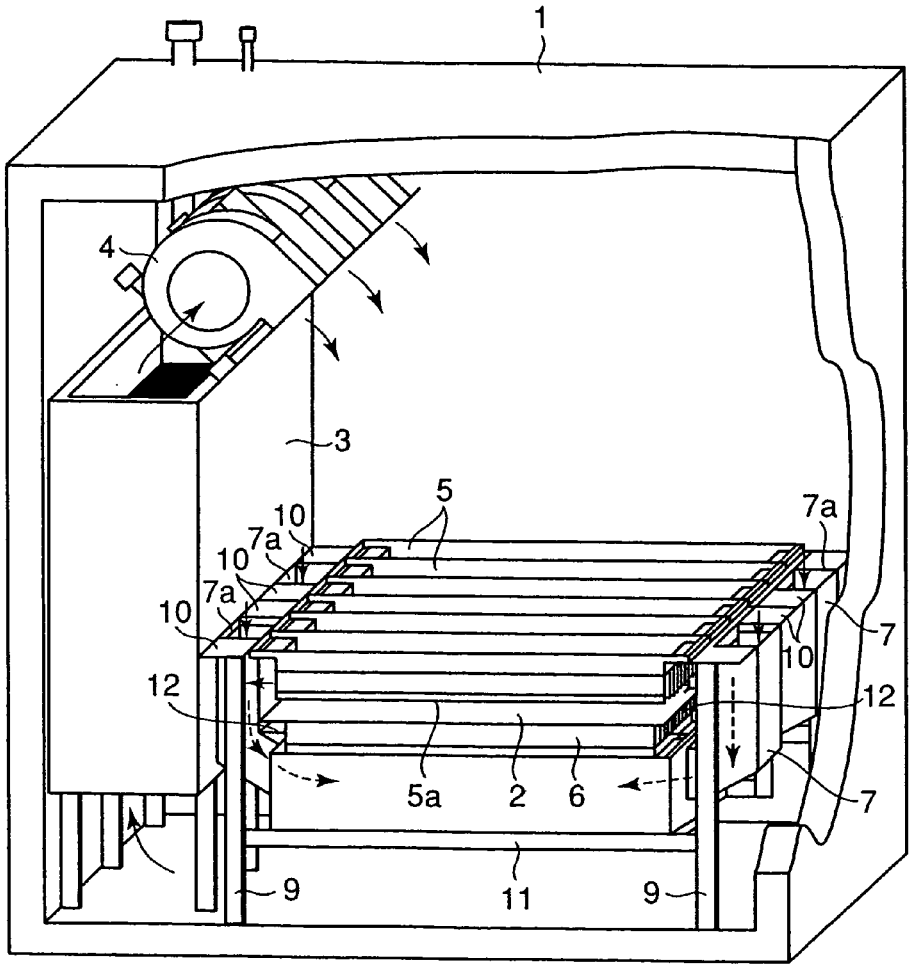
FIG. 4 is a perspective view of the first embodiment of the present invention with partial cutaway viewed from anther direction.

Referring to FIG. 3 and FIG. 4 showing the first embodiment of the present invention, reference numeral 1 is a housing which is preferably composed of heat insulating walls. The housing is closed except an entrance opening and an exit opening not shown in the drawings for entrance and exit of a conveyor belt 2. Chilled air is circulated in the housing. Reference numeral 3 is a cooler and 4 are cooling fans to constitute a part of a chilled air cycle.

Reference numeral 5 are upper slit nozzle units located above the conveyor belt 2. Each of the units 5 is composed of a plurality of upper slit nozzle 5*a*. Reference numerals 9 are columnar supports for supporting the conveyor belt 2, upper slit nozzle units 5, etc. Reference numerals 10 are longitudinal frames attached to the columnar supports 9. A plurality of upper slit nozzle units 5 are placed on the longitudinal frames 10 to be capable of being uplifted. Reference numerals 6 are lower slit nozzle units located under the conveyor belt. Each of the units 6 is composed of a plurality of lower slit nozzles 6*a*. A plurality of lower slit nozzle units are placed on a duct 8 supported on lateral frames 11.

Figure 1:
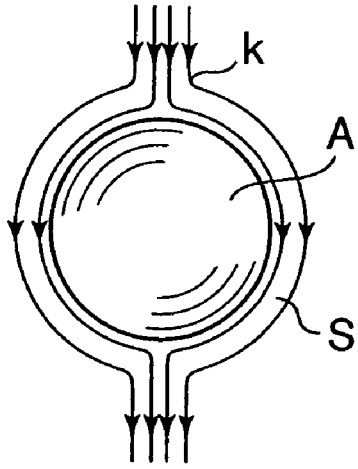
FIG. 1 is a drawing for explaining the principle of Coanda effect.
Figure 2:
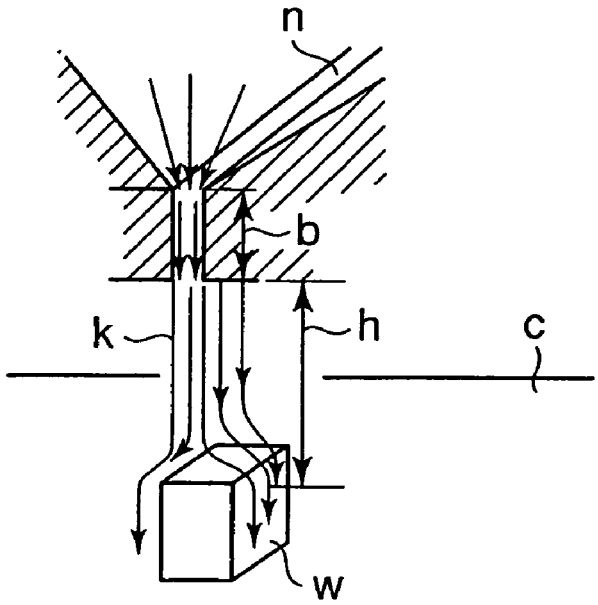
FIG. 2 is a perspective view of the slit nozzle.

The slit nozzle 'n' is shaped to have an entrance way which has a tapered passage(V-shaped in a cross section) and a succeeding parallel passage 'b' as shown in FIG. 2. Each of the upper and lower slit nozzles 5*a* and 6*a* is mounted such that the slit opening thereof extends laterally across the conveyor belt 2. The slit of the slit nozzle may be a continuous aperture so that air curtain is formed by the air spouting out from the slit nozzle or spacers attached at certain intervals along the continuous aperture so that air jets of certain width spout out from the slit nozzle. The type of the slit nozzle is selected in accordance with the kind of articles to be treated.

Chilled air produced by the cooler 3 flows out from the fans 4 toward the upper slit nozzle units 5 as indicated by arrows in FIG. 3 and FIG. 4. Apart of the chilled air flows into ducts 7 from the inlet openings 7*a* of the ducts 7, is introduced to the duct 8 located under the lower slit nozzle units 6 each of which the entrance way is communicated to the duct 8, and then spout out from the lower slit nozzles 6*a* against the undersurface of the conveyor belt 2 to cool indirectly the articles placed on the upper surface of the belt from under the belt.

In the embodiment, the conveyor belt 2 is a steel belt made of steel of good heat conductivity, and the belt is not perforated because the articles on the belt can be cooled indirectly by the chilled air impinging on the undersurface of the belt by virtue of good heat conductivity of the steel belt. It is also suitable to use perforated conveyor belt so that a part of chilled air coming down from above the belt flows down through the holes of the conveyor belt and a part of the chilled air going up from under the belt flows up through the holes of the conveyor belt.

Figure 5:
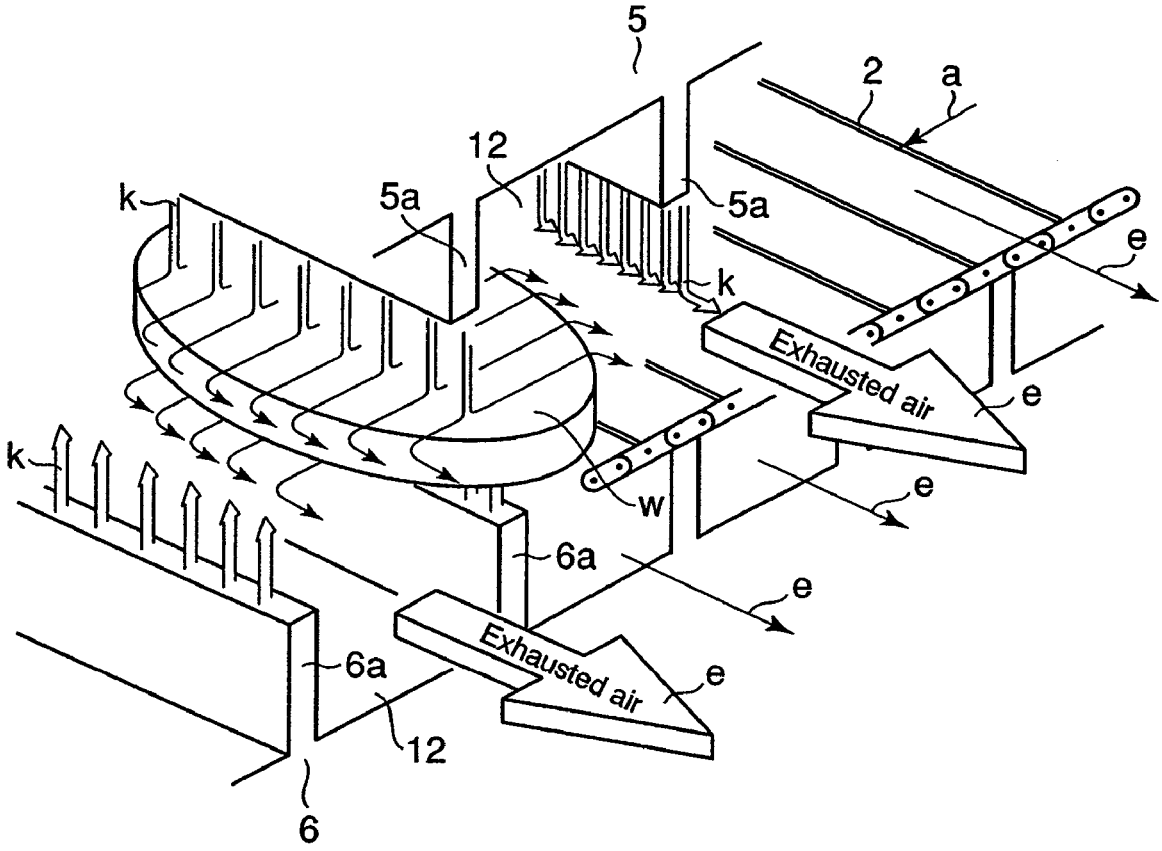
FIG. 5 is a perspective view showing the flow of chilled air jets impinged against the article transferred on the conveyor belt in the case of the first embodiment.

In the first embodiment like this, the conveyor belt 2 transfers in the direction of arrow 'a' with an article 'w' to be treated placed thereon as shown in FIG. 5. On the other hand, chilled air produced by the cooler 3 is directed by the fan 4 to flow toward the upper slit nozzle unit 5. A large part of the chilled air flows into the upper slit nozzles 5*a* to be spouted out from the slit opening thereof as air jet 'k' toward the conveyor belt 2 at right angles to the upper surface thereof, and the air jet 'k' impinges against the article 'w' on the conveyor belt to cool the article. A remaining part of the chilled air flows into the duct 8 passing through the inlet opening 7*a* of the duct 7. The chilled air reaching the duct 8 flows into the lower slit units 6 and spouts out from the lower slit nozzles 6*a* as air jet 'k' toward the undersurface of the conveyor belt 2 at right angles to the undersurface thereof to cool the conveyor belt. By this, the article on the conveyor belt is cooled indirectly by the steel belt 2.

The chilled air impinged on the article 'w' and the undersurface of the conveyor belt 2 is exhausted through the concaves 12 (exhaust passages) formed between each of slit muzzles 5*a* and 6*a* to both lateral end sides of the conveyor belt 2 as shown by arrows e in FIG. 5 (the arrows are shown only in one direction in the drawing). The air exhausted is sucked by the fan 4 through the cooler 3.

According to the installation of the first embodiment, chilled air streams 'k' rectified and given directionality by the upper and lower slit nozzles 5*a* and 6*a* and having increased longitudinal coverage 'h' are allowed to impinge on the articles 'w', so that a stable, thin chilled air stream layer can be formed around the surface of each of the articles by virtue of Coanda effect. Therefore, heat transfer coefficient between the chilled air and the surface of the article is extremely increased when chilled air stream is impinged on the articles and cooling effect is improved.

Further, circulation of air is generated in the housing such that chilled air flows out from said blower to the space above the upper slit nozzles in the housing, a part of the chilled air flows to said upper slit nozzles to be spouted from the upper slit nozzles and exhausted through said exhaust passages, the remaining part of the chilled air flows to said lower slit nozzles through duct shaving openings adjacent both lateral end sides of the conveyor belt to be spouted from said lower slit nozzles and exhausted through said exhaust passages, and the exhausted air returns to said cooler, so that the chilled air spouted from the slit nozzles and cooling the articles 'w' is smoothly exhausted outside of the belt without disturbing the air jets spouted against the articles or atmosphere around the articles.

Further, by forming a concave 12 between each of the upper slit nozzles 5*a* and between each of the lower slit nozzles 6*a* to serve as an exhaust passage respectively, the exhaust passage can be formed easily and the formation thereof does not constitute a limiting factor of providing slit nozzles. In addition, as the air spouted against the conveyor belt 2 is smoothly exhausted outside of both lateral end sides of the conveyor belt 2 and the exhausted air proceeds freely toward the cooler 3 to be sucked by the fan 4, smooth circulation of air is generated in the housing with reduced flow loss.

Further, as a plurality of slit nozzles are integrated to constitute an upper slit nozzle unit 5 and lower slit nozzle unit 6, manufacturing and mounting of the slit nozzles become extremely easy. Further, by constructing such that the upper slit nozzle unit 5 located above the conveyor belt 2 is placed detachably on the longitudinal frames 10 provided adjacent to both lateral end sides of the conveyor belt 2, the slit nozzle unit can be detached easily when performing cleaning, inspection, or maintenance work.

Figure 6:
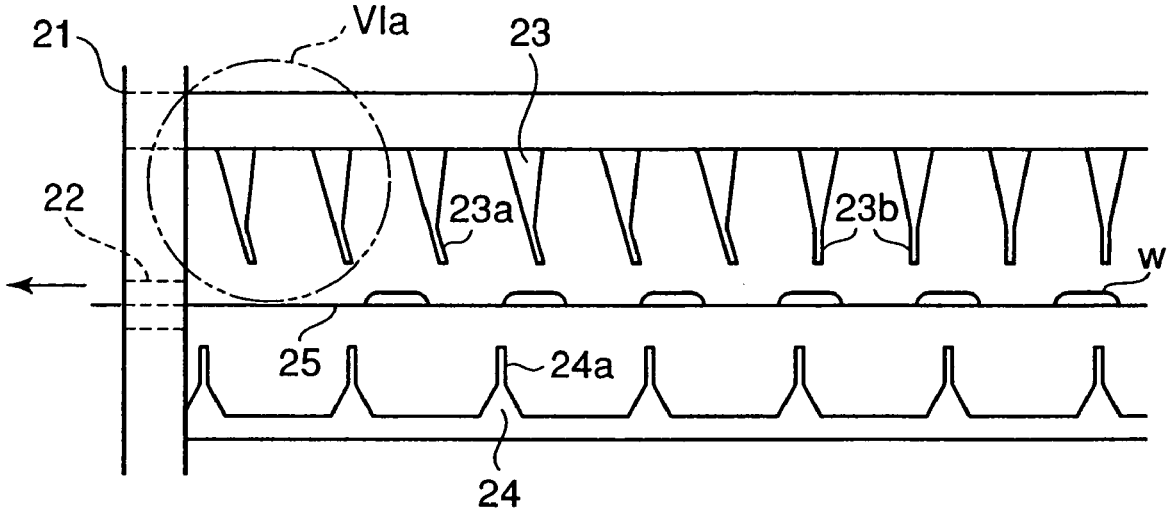
FIG. 6 is a partially enlarged side view schematically representing the second embodiment of the present invention, and FIG. 6(*a*) is an enlarged detail of a part indicated by VIa in FIG. 6.

FIG. 6 is a partially enlarged side view schematically representing the second embodiment of the present invention.

When there is difference between the pressure near the entrance opening and that near the exit opening of the housing, there occurs an air stream flowing from the opening side of higher pressure toward the opening side of lower pressure and the air may flow out from the housing or outside air may flow into the housing. When this occurs, chilled air leaks out of the housing and workers may be adversely affected or outside air intrudes into the housing and the cooler may be frosted resulting in decreased performance of the cooler.

Figure 6A:
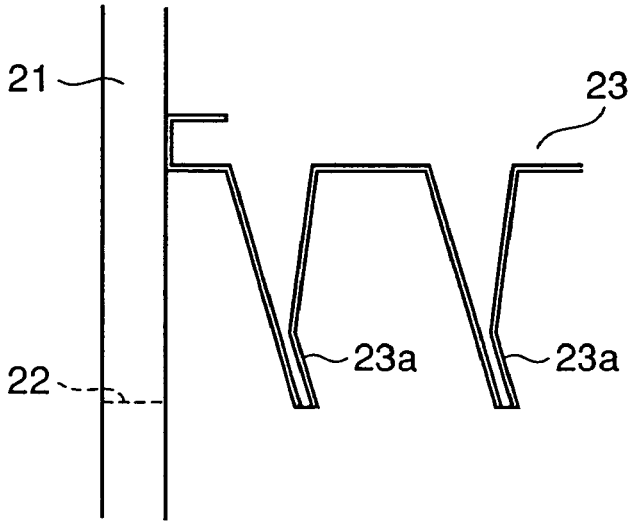
Figure 7:
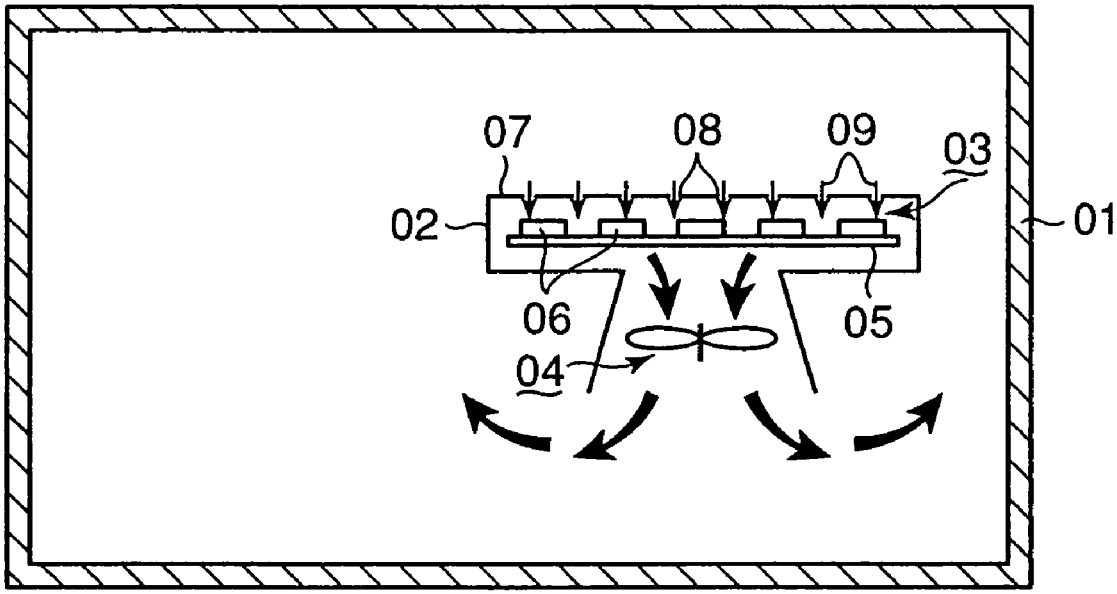
FIG. 7 is a schematic sectional view showing the working principle of an apparatus of prior art, and FIG. 7(*a*) is an enlarged detail of FIG. 7.
Figure 7A:
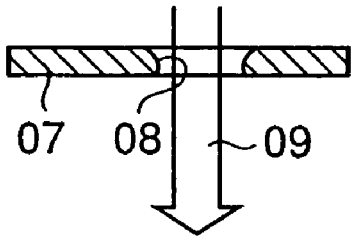

The second embodiment aims to solve this problem. Referring to FIG. 6, when chilled air stream flowing from the entrance opening not shown in the drawing toward exit opening 22 of the housing 21 as shown by an arrow in the drawing, leading end parts 23*a* of slit nozzles of an upper slit nozzle unit 23 located near the exit opening 22 of the housing 21 are slanted to the direction opposite to the exit opening 22. By this, spewing out the chilled air from the exit opening 22 and intrusion of outside air from the entrance opening not shown in the drawing can be prevented. Reference numeral 23*b* are leading end parts of slit nozzles located in positions remote from the exit opening 22 and directed at right angles to a conveyor belt 25. Reference numeral 24 is a lower slit nozzle unit and leading end parts 24*a* thereof are directed at right angles to a conveyor belt 25. Reference mark 'w' are articles transferred on a conveyor belt 25. FIG. 6(A) is an enlarged detail of part VIa in FIG. 6. As mentioned above, blowing out of the chilled air from the housing and intrusion of outside air into the housing can be prevented by slanting some of the leading end parts of the slit nozzles.

Not only some of the leading end part 23*a* of the upper slit nozzles but some of the leading end parts 24*a* of the lower slit nozzles may be slanted. The number of the slit nozzles of which the lead end parts are slanted is decided according to the conditions of the installation.

INDUSTRIAL APPLICABILITY

According to the invention, a continuous transfer type freezer capable of cooling or freezing articles transferred on a conveyor belt efficiently with apparatuses of simple construction installed in a housing is provided, in which chilled air stream layer is formed around the surface of the article by virtue of Coanda effect resulting in an increased cooling effect by using slit nozzles shaped to have an entrance way consisting of a tapered passage and a succeeding parallel passage to form air jets of increased longitudinal coverage not diffusing easily, and in which exhaust passages are formed to allow the air spouted from the slit nozzles to be exhausted toward both lateral end sides of the conveyor belt and chilled air can be circulated smoothly in the housing.

What is claimed is:

1. A continuous transfer type freezer comprising a housing having an entrance opening and an exit opening, a conveyor belt for transferring articles to be cooled from said entrance opening to said exit opening through the housing, a chilled air circulating means consisting of a cooler and a blower, and slit nozzles for spouting chilled air against the articles to be cooled, wherein a plurality of upper slit nozzles and lower slit nozzles are apposed above and under the conveyor belt along the direction of transfer of the belt with the slit of each nozzle perpendicular to the belt transfer direction, and exhaust passages are formed perpendicular to the belt transfer direction between each of the slit nozzles to guide the chilled air spouted from the slit nozzles to both lateral end sides of the conveyor belt.

2. The continuous transfer type freezer according to claim 1, wherein said slit nozzle is shaped to have an entrance way consisting of a tapered passage and a succeeding parallel passage.

3. The continuous transfer type freezer according to claim 1, wherein circulation of air is generated in said housing such that chilled air flows out from said blower to the space above the upper slit nozzles in the housing, a large part of the chilled air flows to said upper slit nozzles to be spouted from the upper slit nozzles and exhausted through said exhaust passages, the remaining part of the chilled air flows to said lower slit nozzles through ducts having openings at both lateral end sides of the conveyor belt to be spouted from said lower slit nozzles and exhausted through said exhaust passages, and the exhausted air returns to said cooler.

4. The continuous transfer type freezer according to claim 1, wherein said exhaust passage is formed to be a concave between said slit nozzles.

5. The continuous transfer type freezer according to claim 1, wherein the leading end part of said slit nozzle located near the entrance opening or exit opening of the housing is inclined in accordance with the difference of pressure between the two openings.

6. The continuous transfer type freezer according to claim 1, wherein a plurality of said slit nozzles are integrated into a slit nozzle unit.

7. The continuous transfer type freezer according to claim 6, wherein the slit nozzle unit consisting of a plurality of the slit nozzles and located above the conveyor belt is placed on frames provided at both lateral end sides of the conveyor belt.

* * * * *